US005951008A

United States Patent [19]

Williams et al.

[11] Patent Number: 5,951,008

[45] Date of Patent: Sep. 14, 1999

[54] OFFSETTING PAPER STACKERS

[75] Inventors: Daniel J. Williams, Westbrook; Frank A. Todaro, Old Saybrook, both of Conn.

[73] Assignee: General Binding Corporation, Northbrook, Ill.

[21] Appl. No.: 08/851,874

[22] Filed: May 6, 1997

[51] Int. Cl.[6] ..... B65H 39/10

[52] U.S. Cl. ..... 271/288; 271/207

[58] Field of Search ..... 271/81, 184, 198, 271/314, 207; 399/404

[56] References Cited

U.S. PATENT DOCUMENTS

| | | | |
|---|---|---|---|
| 4,017,066 | 4/1977 | Lasher et al. . | |
| 4,573,848 | 3/1986 | Lundblad . | |
| 5,088,721 | 2/1992 | Suzuki et al. | 271/293 X |
| 5,096,184 | 3/1992 | Maekawa et al. | 271/207 |
| 5,489,092 | 2/1996 | Kimura et al. | 271/185 X |
| 5,512,996 | 4/1996 | Fare | 399/404 |

FOREIGN PATENT DOCUMENTS

| | | |
|---|---|---|
| 60 24 4969 | 12/1985 | Japan . |
| 02 19 3858 | 7/1990 | Japan . |
| 1 594 488 | 7/1981 | United Kingdom . |

*Primary Examiner*—William E. Terrell
*Assistant Examiner*—Gene O. Crawford
*Attorney, Agent, or Firm*—Hill & Simpson

[57] ABSTRACT

The present invention provides new offsetting paper stacking devices and methods which automatically stack sheets of paper into groups which are offset from each other. The offsetting paper stacker stacks sheets of paper that are feed into an input end of the device one at a time at a high rate of speed. The paper is stacked in one pile, however, within that pile there are groups of sheets that are stacked at a sideways offset to the group immediately above and below. Accordingly, every other group of sheets of paper will be in line with each other and each adjacent group will be offset from each other. The offsetting paper stacker includes stacker wheels which are rotatable about two axes of rotation to stack the paper in an offset manner.

23 Claims, 3 Drawing Sheets

OFFSETTING PAPER STACKERS

FIELD OF THE INVENTION

The present invention generally relates to paper stacking devices which stack sheets of paper into groups that are offset from each other and form an offset paper stack.

BACKGROUND OF THE INVENTION

Printed materials, such as books for example, are typically produced in multiple quantities for efficiency reasons. Generally, the cost to produce a book can be reduced by printing multiple copies of the book during the same printing run. Printing multiple copies of a book takes advantage of the efficiencies of quantities of scale and spreads fixed costs, such as setup costs, over multiple quantities of the book rather than applying those costs to a single copy of the book or relatively few copies. As multiple quantities of a book are produced, the books may be stacked together at some point in the manufacturing line prior to being individually bound. An efficient and cost effective way of determining where any one particular book in the stack begins and ends would be quite useful to separate each individual, unbound book from the stack of books.

SUMMARY OF THE INVENTION

The present invention provides new offsetting paper stacking devices and methods which automatically stack sheets of paper into groups which are offset from each other. An offsetting paper stacker device made in accordance with the principles of the present invention stacks sheets of paper that are fed into an input end of the device one at a time at a high rate of speed. The paper is stacked in one pile, however, within that pile there are groups of sheets that are stacked at a sideways offset to the group immediately above and below. Accordingly, every other group of sheets of paper will be in line with each other and each adjacent group will be offset from each other. The offsetting paper stacker is particularly useful for making books; however, the device may also be used for other applications where it is desirable to easily and efficiently separate sheets of paper.

DETAILED DESCRIPTION OF THE PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

Figure 1:
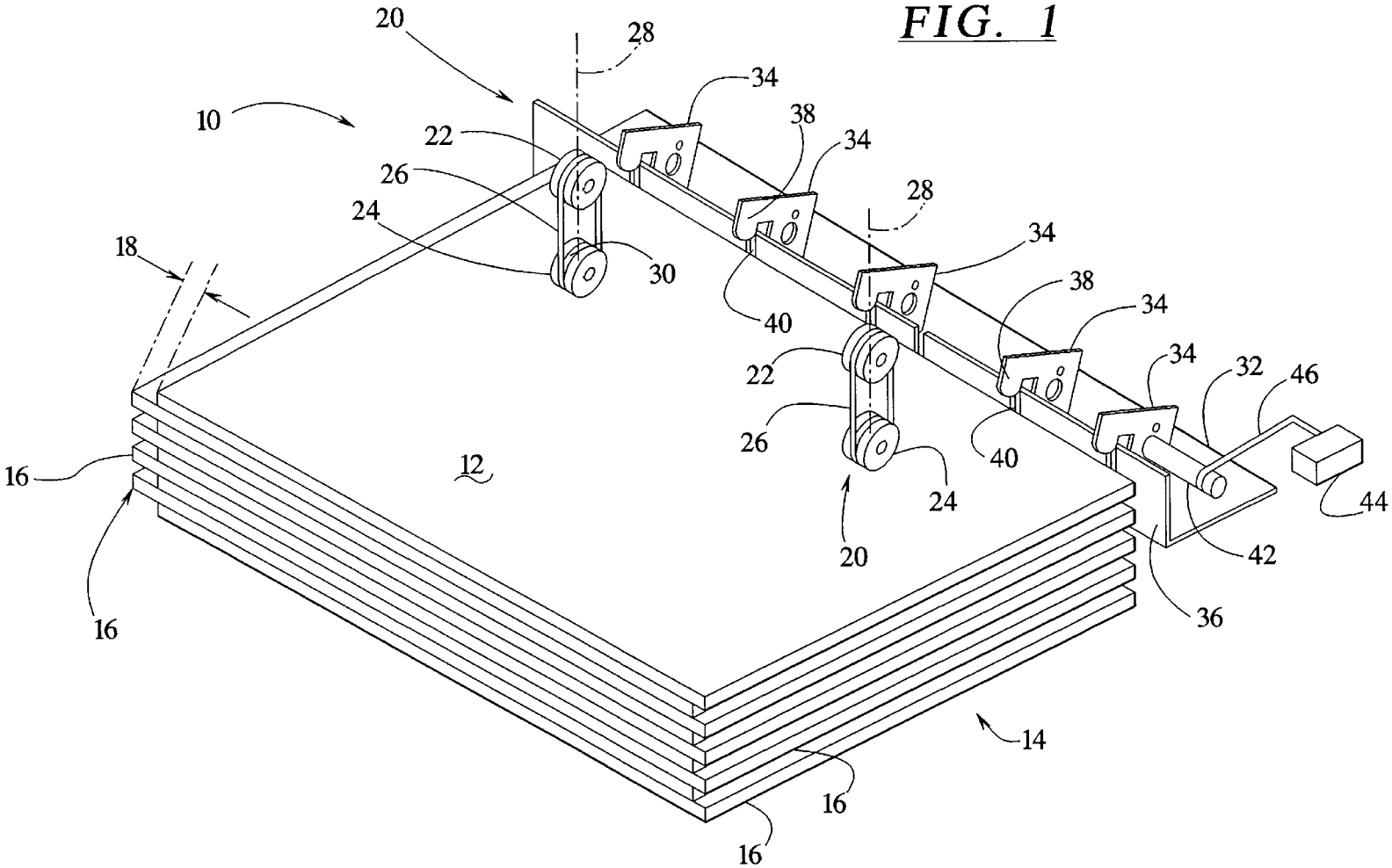
FIG. 1 is a perspective view of an offsetting paper stacker made in accordance with the principles of the present invention and shows a paper stack of groups of sheets of paper offset from each other.

An offsetting paper stacker 10 is shown in FIG. 1 with an offset paper stack 14 stacked by the paper stacker 10. The offset paper stack 14 includes multiple sheets of paper 12 which are stacked into groups of sheets of paper 16, for example books. A book is a number of sheets of paper 12 that will be offset together as a group 16 and can be any number of sheets of paper 12. The offset paper stack 14 is a pile of previously stacked books or groups of sheets of paper 16 under the offsetting paper stacker 10. Each adjacent group of sheets of paper 16 is offset from each other by offset 18. As shown in FIG. 1, the ends of every other group of sheets of paper 16 are aligned with each other. The offset paper stacker 10 automatically descends as sheets of paper 12 accumulate on top of the stack 14.

The offsetting paper stacker 10 includes a pair of spaced apart paper stackers 20 which stack the sheets of paper 12 into the groups 16 that are offset from each other. Each paper stacker 20 includes a drive wheel 22 which drives a stacker wheel 24 by use of a round belt 26. The drive wheels 22 are connected together and to a motor by a drive axle 23 (FIG. 2) which provides power to drive the wheels 22, the round belts 26 and the stacker wheels 24. The drive wheels 22 are positioned vertically above their respective stacker wheels 24 and are driven about a horizontal axis defined by the drive axle 23. Each stacker wheel 24 is rotationally driven about a horizontal axis defined by a stacker wheel axle 25 (FIG. 3). Each stacker wheel 24 has its own stacker wheel axle 25 which are connected together by a stacker wheel axle linkage 27. Each stacker wheel 24 is rotatable about a vertical axis of rotation 28 by the stacker wheel axle linkage 27. Each of the round belts 26 applies power to its respective stacker wheel 24 from its drive wheel 22. The round belts 26 are positioned in annular grooves 30 in the stacker wheel 24 and in the drive wheels 22. The round belts 26 permit the stacker wheels 24 to rotate relative to the drive wheels 22 about the vertical axis of rotation 28. Also, the round belts 26 track around the outside of the stacker wheels 24 and act as a drive surface to the sheets of paper 12 as the sheets are stacked by the offsetting paper stacker 10. The stacker wheels 24 rest on top of the offset paper stack 14 and rotate with a tangential velocity at the round belts 26 which is slower than the rate of travel of the sheet of paper 12 entering the offsetting paper stacker 10.

The offsetting paper stacker 10 also includes a backstop 32 and a plurality of spaced apart paper tappers 34 as shown in FIG. 1. The backstop 32 has a vertical flat surface 36 which stops the sheets of paper 12 at their final position on top of the offset paper stack 14. The paper tappers 34 are linked together for reciprocating movement by a rotatable paper tapper shaft 42 and have fingers 38 that can pack down each sheet of paper 12 after the sheet of paper 12 reaches the backstop 32. Slots 40 may be provided in the backstop 32 to permit travel of the paper tappers 34.

Figure 2:
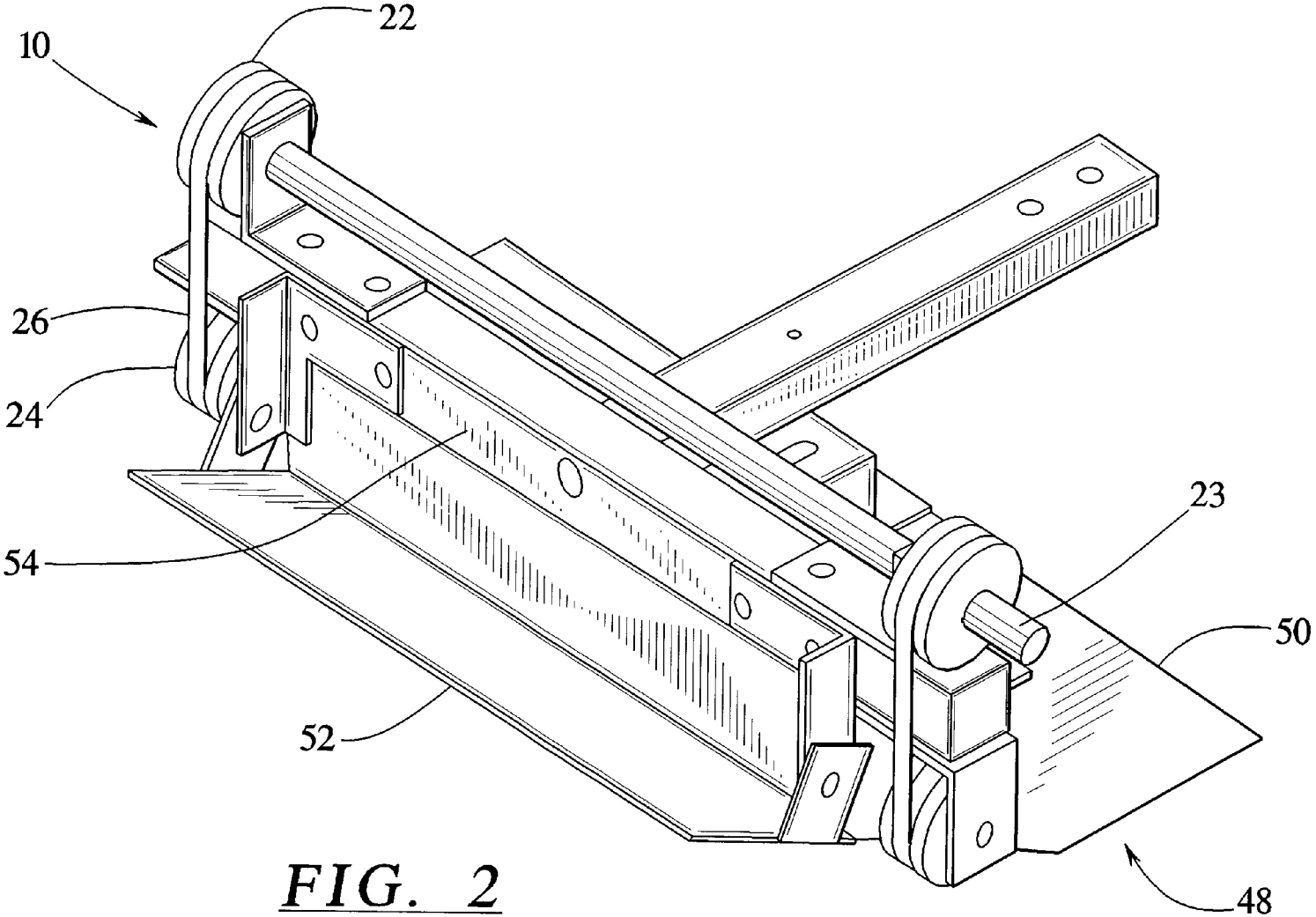
FIG. 2 is an isometric view of the offsetting paper stacker of FIG. 1 showing the stacker in greater detail.
Figure 3:
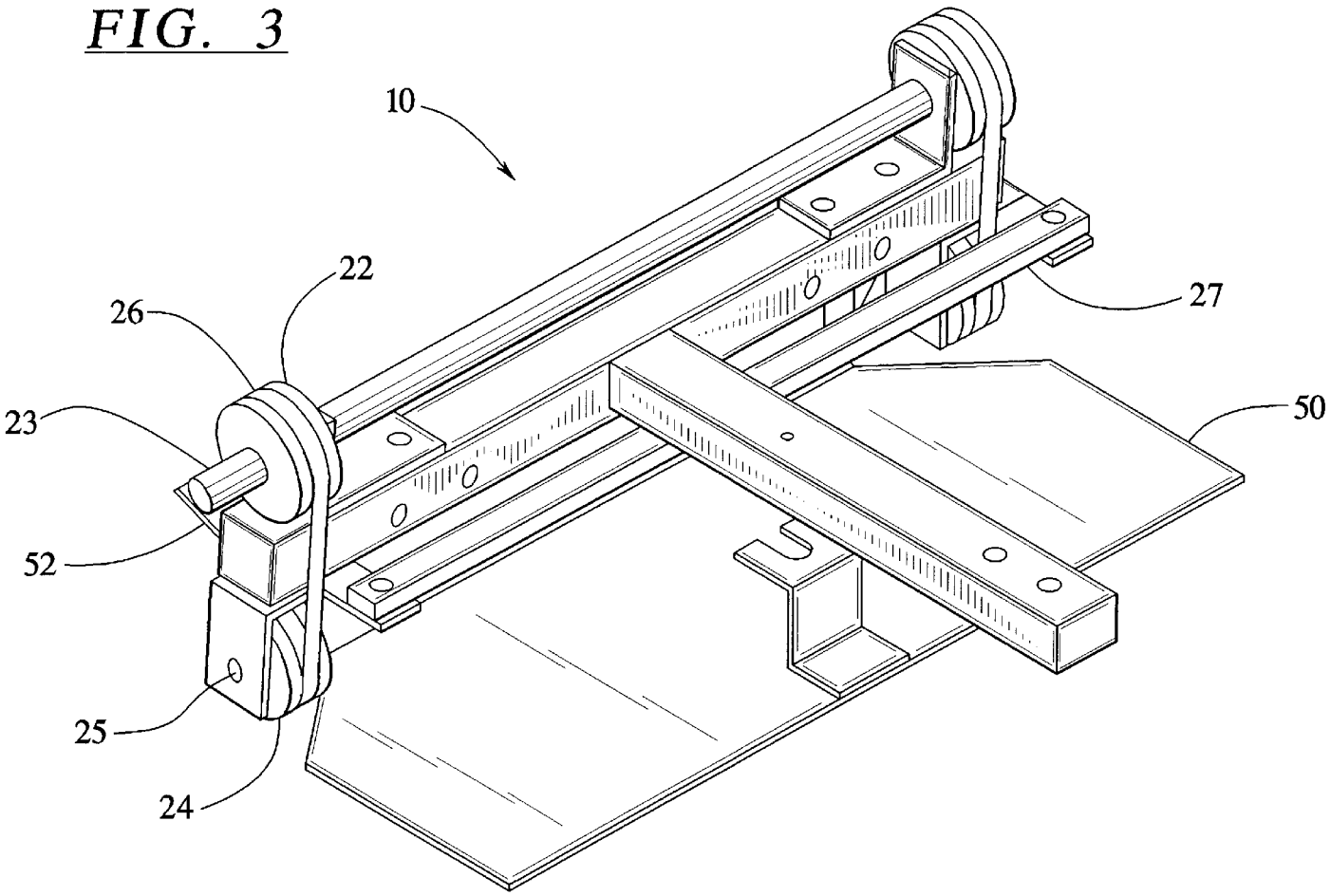
FIG. 3 is another isometric view of the offsetting paper stacker of FIG. 2.

The offsetting paper stacker 10 also includes an anti-buckling device 48 shown in FIGS. 2 and 3. Once the sheet of paper 12 reaches the backstop 32, the anti-buckling device 48 is used to prevent the sheet of paper 12 from buckling until the next sheet of paper 12 enters the offsetting paper stacker 10. This is done by holding the sheet of paper 12 down on the offset paper stack 14 with enough normal force to prevent buckling of the sheet of paper 12, but not enough force to stop the sheet of paper 12 from sliding into position on top of the offset paper stack 14. The anti-buckling device 48 includes a paper holding section 50 which prevents buckling and an angled paper feeding section 52 which also assists in feeding the sheets of paper 12 to the stacking wheels 24. Alternative construction of the anti-buckling device 48 may include a strap, a plate, a roller or combination thereof, for example. The anti-buckling 48 device is connected to a framework 54 of the offsetting paper stacker 10.

Operation of the offsetting paper stacker 10 will now be described. As the sheet of paper 12 enters the offsetting paper stacker 10, the sheet 12 contacts the paper feeding section 52 which guides the sheet 12 to the stacker wheels 24. The stacker wheels 24 ride on top of the offset paper stack 14 and exert a normal force on the top sheet of paper 12 due to gravity. The sheet of paper 12 is fed at a relatively high rate of speed between the offset paper stack 14 and the stacker wheels 24 and the round belts 26 which pinch the sheet of paper 12 to slow it down with frictional drag to the tangential velocity of the stacker wheels 24. The sheet of paper 12 continues on at a relatively slow speed until it comes to rest against the vertical flat surface 36 of the backstop 32. The stacker wheels 24 continue to rotate and drive but slip on the top sheet of paper 12 until the next sheet of paper 12 enters the offset paper stack 14. The sheet of paper 12 can be prevented from buckling with the antibuckling device until the next sheet of paper 12 enters the offsetting paper stacker 10.

The offset 18 of the offset paper stack 14 occurs by rotating each stacker wheel 24 about its respective vertical axis of rotation 28 which extends through the center of each stacker wheel 24. The rotated stacker wheels 24 track the sheet of paper 12 at an angle to the original direction of travel of the sheet of paper 12 into the offsetting paper stacker 10. The stacker wheels 24 remain at the specified angle until the group of sheets of paper (book) 16 is finished being stacked. After the book 16 is stacked, the stacker wheels 24 are rotated about their respective vertical axis of rotation 28 between the last stacked sheet of paper 12 and the next incoming sheet of paper 12 to an angle that will track the next incoming sheet of paper 12 toward the opposite side of the offset paper stack 14. The stacker wheels 24 are linked together by the mechanical stacker wheel axle linkage 27 and rotate in the same direction to the same angle about their respective vertical axis of rotation 28. When the stacker wheels 24 switch direction to start stacking a new book 16, the top sheet of paper 12 of the previous book 16 is held in place with static friction between itself and the sheet of paper 12 underneath the top sheet and between itself and the vertical flat surface 36 of the backstop 32. The stacker wheels 24 are mounted to the framework 54 which can pivot vertically and allow the stacker wheels 24 to maintain a constant force on the offset paper stack 14 even though the height of the offset paper stack 14 may vary.

The distance of the offset 18 is established by the tracking angle and the distance that the sheet of paper 12 is tracked before reaching the backstop 32. Therefore, each sheet of paper 12 offsets the same amount of distance at offset 18, without the use of a guide on the side of the sheet of paper 12. This provides the offsetting paper stacker 10 with the ability to stack different widths of paper without adjustment. Additionally, because the trailing edge of the sheet of paper 12 does not flip up to any type of stop or aligner, the length of the sheet of paper 12 can vary without the need for adjustment. Accordingly, the sheet of paper 12 can have a shape other than rectangular or square as long as the sheet of paper 12 has a leading edge that will stop the sheet of paper 12 consistently against the vertical flat surface 36 of the backstop 32.

Sometimes it is desirable to punch holes in the leading edge of the sheet of paper 12 for binding the group of sheets of paper 16 together. When holes are provided in the sheets of paper 12 the paper may tend to fluff up where the holes are punched. In order to maintain a relatively flat offset paper stack 14, the paper tappers 34, particularly the fingers 38, are used to push down each sheet of paper 12 along its leading edge once the sheet of paper 12 reaches the vertical flat surface 36 on the backstop 32. The paper tappers 34 are connected to the rotatable shaft 42 which is linked to solenoid 44 by a link 46. The solenoid 44 actuates to rotate the shaft 42 and the paper tappers 34 into contact with the top sheet of paper 12 after the sheet of paper 12 comes to rest against the vertical flat surface 36. The solenoid 44 then rotates the shaft 42 to lift the papers tappers 34 up off the sheet of paper 12 before the next sheet of paper reaches the backstop 32.

While the presently preferred embodiments have been illustrated and described, numerous changes and modifications can be made without significantly departing from the spirit and scope of this invention. Therefore, the inventors intend that such changes and modifications are covered by the appended claims.

The invention is claimed as:

1. An Offsetting paper stacker for stacking sheets of paper in an offset paper stack comprising:

a stacker wheel mounted on a stacker wheel axle, the stacker wheel and the stacker wheel axle rotatable about first and second axes of rotation, the stacker wheel positioned vertically above a paper stacking area;

a driver linked to the stacker wheel, wherein the driver rotates the stacker wheel about the first axis of rotation such that the stacker wheel moves the sheets of paper toward their stacked positions;

a stacker wheel link connected to the stacker wheel and the stacker wheel axle, wherein the stacker wheel link rotates the stacker wheel and the stacker wheel axle about the second axis of rotation such that the stacker wheel can change the direction of travel of the sheets of paper; and a backstop spaced apart from the stacker wheel which defines a stop for the sheets of paper.

2. The offsetting paper stacker of claim 1 wherein the backstop comprises a vertical surface capable of stopping the sheets of paper.

3. The offsetting paper stacker of claim 1 further comprising an anti-buckling device mounted to a framework of the offsetting paper stacker, wherein the anti-buckling device has a substantially flat paper holding section.

4. The offsetting paper stacker of claim 1 further comprising a paper feeding section positioned at an upward extending angle in front of the stacker wheel.

5. The offsetting paper stacker of claim 1 further comprising a paper tapper moveable into and out of contact with a top sheet of paper after the stacker wheel moves the top sheet of paper into position.

6. The offsetting paper stacker of claim 5 further comprising a plurality of spaced apart paper tappers.

7. The offsetting paper stacker of claim 1 wherein the driver comprises a drive wheel linked to the stacker wheel by a flexible belt.

8. The offsetting paper stacker of claim 7 wherein the belt is round in cross-section.

9. The offsetting paper stacker of claim 1 further comprising a pair of stacker wheels linked together by the stacker wheel link, wherein the stacker wheel link rotates each stacker wheel about their respective second axis of rotation.

10. The offsetting paper stacker of claim 9 wherein the driver comprises a pair of driver wheels in which each driver wheel is rotatable connected to one of the stacker wheels by a belt.

11. An offsetting paper stacker for stacking sheets of paper offset from each other comprising:

a pair of stacker wheels, each stacker wheel mounted on a stacker wheel axle, each stacker wheel and stacker wheel axle rotatable about a substantially horizontal axis and a substantially vertical axis, the stacker wheels positioned vertically above a paper stacking area;

a pair of drive wheels, each drive wheel rotatably connected to one of the stacker wheels by a belt; and a backstop spaced apart from the pair of stacker wheels and being capable of stopping the sheets of paper which are fed to the pair of drive wheels.

12. The offsetting paper stacker of claim 11 further comprising a paper anti-buckling device having a paper feeding section at a paper inlet side of the pair of stacker wheels and a paper holding section at a paper outlet side of the pair of stacker wheels.

13. The offsetting paper stacker of claim 12 further comprising a stacker wheel linkage connected to each one of the pair of stacker wheels, wherein the stacker wheel linkage rotates the pair of stacker wheels about their respective vertical axes.

14. The offsetting paper stacker of claim 13 wherein the paper feeding section of the anti-buckling device has a substantially flat plate positioned at an angle relative to the stacked sheets of paper, and wherein the paper holding section of the anti-buckling device has a substantially flat plate positioned on top of the stacked sheets of paper.

15. The offsetting paper stacker of claim 13 further comprising a paper tapper adjacent the backstop, the paper tapper having alternate positions in contact with an spaced away from a top sheet of paper of the sheets of paper.

16. The offsetting paper stacker of claim 15 wherein the paper tapper comprises a plurality of spaced apart fingers connected to a rotatable tapper shaft.

17. A method of stacking sheets of paper into offset groups of sheets of paper comprising the steps of:

rotating a stacker wheel mounted on a stacker wheel axle about a first axis of rotation, vertically above a paper stacking area;

feeding the sheets of paper one at a time to the stacker wheel;

moving a selected number of the fed sheets of paper to a first position with the stacker wheel;

rotating the stacker wheel and the stacker wheel axle about a second axis of rotation; and moving another selected number of the fed sheets of paper to a second position offset from the first position with the stacker wheel.

18. The method of stacking sheets of paper into offset groups of sheets of paper of claim 17 wherein the step of rotating a stacker wheel further comprises the steps of:

rotating a pair of coaxial, spaced apart drive wheels;

rotating one stacker wheel of a pair of spaced apart stacker wheels with one of the rotating drive wheels; and rotating another stacker wheel of the pair of stacker wheels with another one of the rotating drive wheels.

19. The method of stacking sheets of paper into offset groups of sheets of paper of claim 17 further comprising the step of tapping down leading edges of each one of the offset groups of sheets of paper.

20. The method of stacking sheets of paper into offset groups of sheets of paper of claim 17 further comprising the step of anti-buckling each one of the sheets of paper as the sheet of paper is being stacked.

21. The method of stacking sheets of paper into offset groups of sheets of paper of claim 17 further comprising the step of maintaining contact of the stacker wheel with a top sheet of paper as the sheets of paper are stacked.

22. An offsetting paper stacker for stacking sheets of paper in an offset paper stack comprising:

a stacker wheel rotatable about first and second axes of rotation;

a driver linked to the stacker wheel, wherein the driver rotates the stacker wheel about the first axis of rotation such that the stacker wheel moves the sheets of paper toward their stacker positions;

a stacker wheel link connected to the stacker wheel, wherein the stacker wheel link rotates the stacker wheel about the second axis of rotation such that the stacker wheel can change the direction of travel of the sheets of paper;

a backstop spaced apart from the stacker wheel which defines a stop for the sheets of paper; and a paper tapper movable into and out of contact with a top sheet of paper after the stacker wheel moves the top sheet of paper into position.

23. A method of stacking sheets of paper into offset groups of sheets of paper comprising the steps of:

rotating a stacker wheel about a first axis of rotation;

feeding the sheets of paper one at a time to the stacker wheel;

moving a selected number of the fed sheets of paper to a first position with the stacker wheel;

rotating the stacker wheel about a second axis of rotation;

moving another selected number of the fed sheets of paper to a second position offset from the first position with the stacker wheel; and tapping down leading edges of each one of the offset groups of sheets of paper.

* * * * *